United States Patent [19]

Acevedo

[11] 4,235,133

[45] Nov. 25, 1980

[54] TORQUE-APPLYING FREELY-REVERSIBLE TOOL AND DRIVE-HANDLE COUPLING

[76] Inventor: Ignacio Acevedo, 4066 Fenwick Rd., Columbus, Ohio 43220

[21] Appl. No.: 56,594

[22] Filed: Jul. 11, 1979

[51] Int. Cl.[3] ..... B25B 13/00

[52] U.S. Cl. ..... 81/58; 145/76; 192/41 S; 192/48.92

[58] Field of Search ..... 81/58, 60; 145/76, 77; 192/41 S, 48.92

[56] References Cited

U.S. PATENT DOCUMENTS

| | | | |
|---|---|---|---|
| 2,105,330 | 1/1938 | Pagenkopf | 192/41 S |
| 2,629,415 | 2/1953 | Baker | 145/76 |
| 2,895,578 | 7/1959 | Winchell | 192/41 S |
| 2,950,746 | 8/1960 | Towne | 145/77 |
| 4,143,693 | 3/1979 | Acevedo | 145/76 |

FOREIGN PATENT DOCUMENTS

| | | | |
|---|---|---|---|
| 515661 | 1/1931 | Fed. Rep. of Germany | 81/58 |
| 433366 | 7/1947 | Italy | 192/41 S |

*Primary Examiner*—James L. Jones, Jr.
*Attorney, Agent, or Firm*—William V. Miller

[57] ABSTRACT

A coupling used between a handle and a tool having outwardly-opening tool-receiving sockets at its opposed ends for selectively receiving a tool shank and a separate intermediate torque-applying sleeve having outwardly-opening sockets at its opposed ends for selectively receiving a driving handle shank after it is passed through the cooperative tool socket. A pair of reversely-wound springs surround the sleeve and when the handle shank is in one end socket of the sleeve and is turned in one direction, it will drive the tool socket at the other end, but the handle shank and socket can be freely turned in a reverse direction.

7 Claims, 9 Drawing Figures

TORQUE-APPLYING FREELY-REVERSIBLE TOOL AND DRIVE-HANDLE COUPLING

BACKGROUND OF THE INVENTION AND PRIOR ART

The present invention relates to a very simple coupling which can be provided between a tool element and a torque-applying handle assembly, both being readily separable therefrom. The coupling is of such a nature that when the handle is turned in one direction, torque is applied to the tool element but when it is turned in a reverse direction no torque is applied and the handle is freely reversible relative to the tool element. This is accomplished with a spring clutch arrangement which is assembled as a separate coupling that is provided with opposed outwardly-opening sockets in its opposite ends for removably receiving the shanks of a tool element and driving handle assembly, respectively. U.S. Pat. No. 2,950,746 discloses a spring clutch arrangement for applying torque to a tool and permitting free reversal but this must be incorporated in the handle assembly itself whereas the present invention is made as a simple inexpensive yet effective separate coupling.

SUMMARY OF THE INVENTION

The coupling of this invention is made so that it receives the shank of a tool in a socket arrangement at one end and the shank of a handle assembly in a socket arrangement at the other end. This permits torque to be applied by the handle to turn it in one direction but free reversal of the handle. Repositioning the tool shank and handle shank in the sockets at the opposite ends of the coupling permits driving the tool in the opposite direction with free reversal of the handle.

The above is accomplished by providing a coupling which comprises a pair of axially-aligned tool-receiving sockets and a separate intermediate torque-applying sleeve. Each tool-receiving socket opens outwardly to receive the shank of a tool and opens inwardly to connect with an outwardly-opening socket in the adjacent end of the sleeve. This latter socket is adapted to receive the torque-applying shank of a handle assembly after it is passed through the tool socket in which it is free to rotate. Around, the torque-applying sleeve are provided a pair of reversely-wound, abutting springs, each of which has an inner portion in frictional engagement with the exterior surface of the sleeve and an outer portion in similar engagement with a corresponding surface of the socket.

In use, the tool will be inserted in the socket at one end but will not extend into the adjacent sleeve socket. The handle shank will be passed through the tool socket at the other end into the adjacent socket of the torque-applying sleeve. When the handle is turned, it will tighten the spring at the opposed end and drive that socket with the tool element but the handle can be reversed freely. To drive the tool in the opposite direction, the tool shank and handle shank will be removed and inserted at the opposite ends of the coupling.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
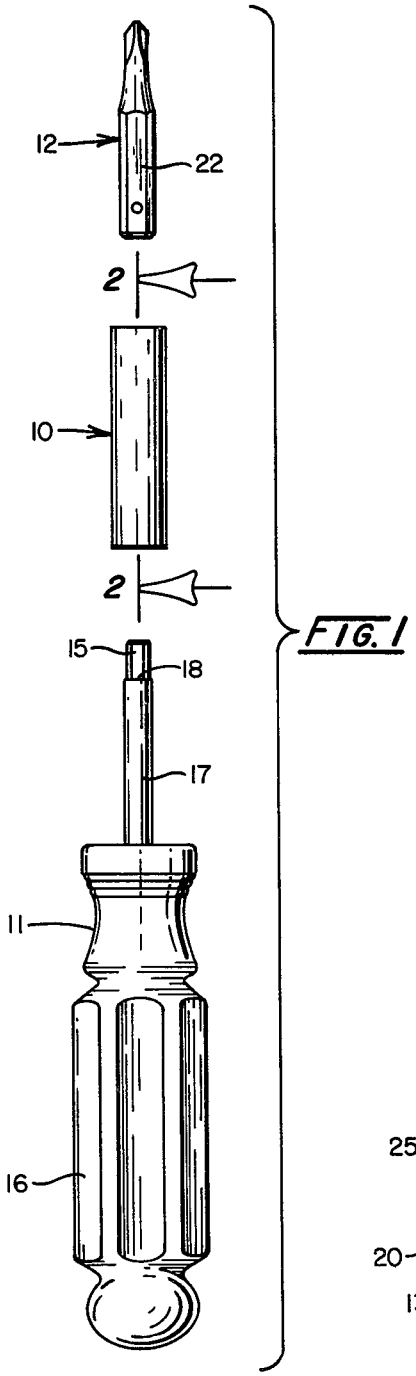
FIG. 1 is an elevational view showing the separated coupling of this invention axially between a drive-handle assembly and a tool element.
Figure 6:
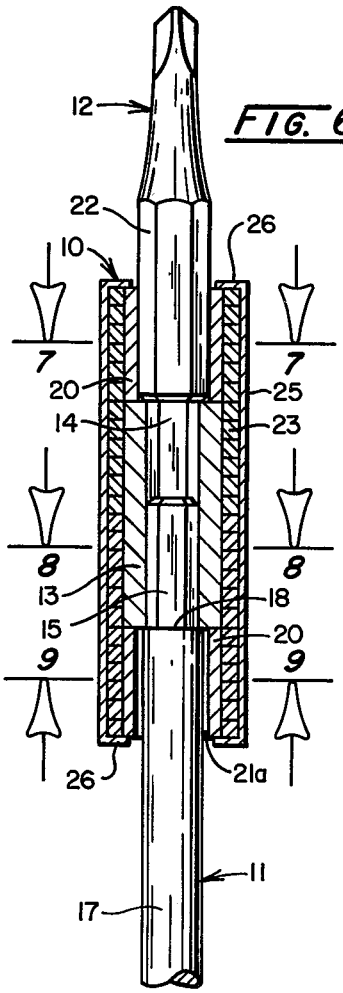
FIG. 6 is an axial sectional view showing the coupling and the shanks of the tool element and handle assembly positioned respectively, at the opposed ends thereof.
Figure 7:
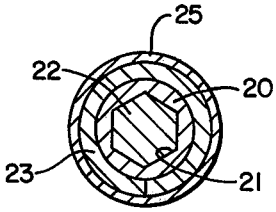
FIG. 7 is a transverse sectional view taken along line 7—7 of FIG. 6.
Figure 8:
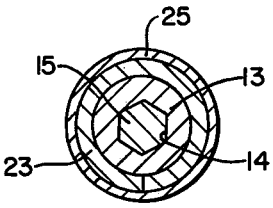
FIG. 8 is a transverse sectional view taken along line 8—8 of FIG. 6.

With specific reference to the drawings, the coupling of this invention is indicated generally by the numeral 10 and is shown separately in FIG. 1, and receiving a torque-applying or driving handle assembly 11 and a tool element 12 in FIG. 6. It is to be understood that the handle assembly and tool element are only examples of various handles and tools with which the coupling 10 of this invention can be used.

Figure 4:
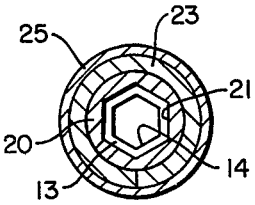
FIG. 4 is a transverse sectional view taken along line 4—4 of FIG. 2.
Figure 5:
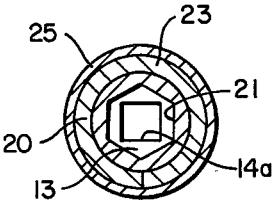
FIG. 5 is a similar view showing a different shape handle shank-receiving socket for the coupling.

The coupling 10 includes the torque-applying sleeve 13 which has a cylindrical outer surface and a bore 14 extending therethrough which may be hexagonal as indicated (FIG. 4) or any other suitable angular cross-section, such as the square bore **14*a* (FIG. 5), depending on the cross-sectional shape of the angular tool shank to be inserted. This bore provides axially outwardly-opening angular sockets at the opposed ends of the sleeve 14 for receiving the complementally shaped shank end portion 15 of the driving handle. In the example shown, the handle assembly has the hand grip 16 and the axially-extending driving shank 17 but various other handle assemblies could be used, for example, a Stillson type wrench. At the inner extent of the shank end portion 15 is a stop shoulder 18**.

At the opposite ends of the torque-applying sleeve 13, in axial alignment and abutting therewith, are the separate tool-receiving socket members 20. Each socket is of sleeve form having an angular socket 21 which opens axially outwardly to receive the shank 22 of the tool element 12. Each socket 21 also communicates at its inner end with the bore 14 of the sleeve 13 but is of greater cross-sectional area than the bore. The socket 21 is shown as being of hexagonal cross-section but may be of square or any other cross-section complemental to that of the tool shank 22. In the example shown, the tool element 12 is a Phillips screwdriver with a hexagonal shank but various other tool elements may be used and they may have differently shaped shanks. The outer surface of each socket member 20 is cylindrical and of the same diameter as the outer cylindrical surface of the sleeve 13 so that, in effect, it is a continuation thereof.

Figure 2:
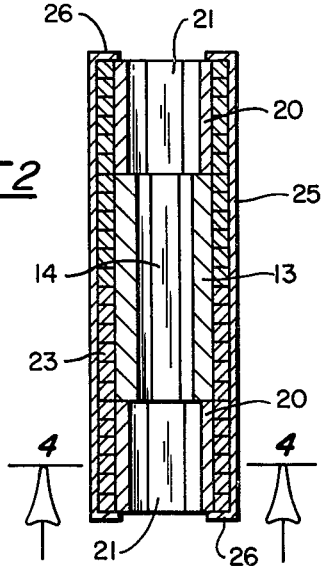
FIG. 2 is an enlarged axial sectional view taken on line 2—2 of FIG. 1 showing the coupling.
Figure 3:
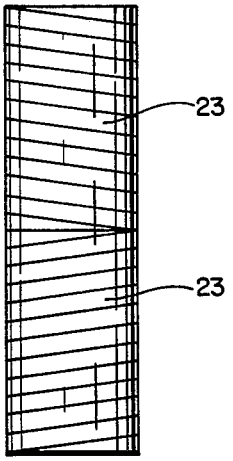
FIG. 3 is an elevational view of the coupling with the cover and retainer sleeve removed.

Surrounding the aligned intermediate sleeve 13 and the opposed sockets 20 are the reversely-wound (FIG. 3) torsion coil spring 23 which are preferably made of flat steel wire so that they will have better gripping action when tightened around the members they enclose. They are initially disposed in snug frictional relationship surrounding these members and in abutting relationship to each other. A retainer and cover sleeve 25, preferably of metal, is disposed around the aligned spring 23 and is crimped over at its ends to provide radially inwardly extending retaining flanges 26 which extend over both the outer end of the adjacent springs 23 and the outer ends of the enclosed sockets 20 to hold the entire coupling assembly together, as indicated in FIG. 2.

Figure 9:
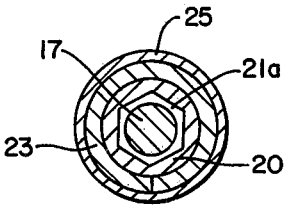
FIG. 9 is a transverse sectional view taken along line 9—9 of FIG. 6.

In using this coupling, 10 assuming the units are separated as shown in FIG. 1, the end 15 of the shank 17 of the handle assembly 11 is inserted through one of the end tool sockets 21 of the coupling into the drive socket in the adjacent end of the bore 14 of sleeve 13. Axial inward movement will be limited by shoulder 18 contacting the outer end of torque-applying or drive sleeve 13, as shown in FIG. 6. It will be noted that there is a space 21a (FIG. 6 and 9) in tool socket 21 around the end portion 15 so it can rotate in this socket when driving sleeve 13. The shank 22 of the tool element 12 is inserted into the socket 21 at the opposite end of the coupling until its inner end conacts the sleeve 13 since it is larger than the sleeve bore 14. Now if the tool is engaged with the work and the hand grip 16 is turned in a clockwise direction, the sleeve 13 will be rotated to turn with or within the nearest or innermost spring 23, which it tends to unwind, and frictionally engage the outermost or spring adjacent the tool element 12 to wind it tightly on the cylindrical exteriors of the sleeve 13 and socket 20 to clutch them together. This will apply torque from the hand grip 16 to the tool shank 22 to drive the tool and the work engaged thereby. Free reversal or counter-clockwise turning of the hand grip 16 will be permitted, since reverse rotation of sleeve 13 will unwind the formerly driving or outermost spring without tightening the innermost spring since it is not anchored to the work and will merely turn with the sleeve. To drive the tool element 12 and the work in a reverse direction, for example to remove a screw, it is merely necessary to interchange the positions of the tool element 12 and handle assembly 11 on the coupling 10. The retainer and cover sleeve 25 not only holds the parts axially assembled but prevents outward bulging of the springs 23 when unwinding.

It will be apparent that this invention provides a simple inexpensive separate coupling adapted to couple a handle assembly to a tool element to apply driving torque but to permit reverse rotation of the handle freely. The coupling is of the spring clutch type but is formed as a small unit within an enclosing sleeve for selectively receiving the tool at opposed ends to drive it in opposite directions. However, in each instance the tool element is driven through the torque-applying sleeve, one of the clutch springs surrounding the sleeve, and the tool socket mounted in abutting relationship to the sleeve and surrounded by that same spring.

Having thus described the invention what is claimed is:

1. A torque-applying coupling having oppositely-opening socket arrangements for interchangeably receiving the shanks of a handle element and tool element, respectively; said coupling comprising:

a torque-applying sleeve having axially outwardly-opening drive sockets at its opposed ends for selectively removably receiving the end of a tool shank;

a tool-receiving socket member at each end of the sleeve axially outwardly thereof having an axially outwardly-opening socket which also communicates at its inner end with a drive socket in the adjacent outer end of the sleeve and permits free passage of the tool shank end and relative rotation therein;

said tool-receiving socket members and said sleeve having exterior spring-engaging surfaces; and a pair of reversely-wound axially-disposed coil springs disposed around said exterior surfaces of the socket members and sleeve, each one of which has an inner portion extending axially inwardly over the sleeve and an outer portion extending axially-outwardly over the tool socket member which is outwardly of the sleeve.

2. A coupling according to claim 1 in which:

said sleeve member is intermediate the socket members which are at each end and which are all disposed in axially-abutting relationship;

said springs having their inner ends in abutting relationship.

3. A coupling according to claim 2 in which:

said sleeve members and said socket members have exterior spring-engaging surfaces which are substantially continuous;

said springs being of uniform diameter throughout and mounted on said surfaces.

4. A coupling according to claim 3 including:

a cover and retainer sleeve mounted on the exteriors of said springs and having retaining flanges at each end engaging the respective spring ends and end socket members.

5. A coupling according to claim 4 in which:

said torque-applying tube has a bore extending therethrough axially which provides the drive sockets at its opposed ends;

said tool-receiving socket members having its sockets extending completely therethrough axially;

said tool sockets being of greater cross-sectional area than said tube bore.

6. A coupling according to claim 5 in which:

each of the sockets in the socket members and the tube bore are of angular cross-section.

7. In combination with the coupling of claim 5;

a tool element and handle element each having a shank adapted to be inserted in the coupling;

the tool element shank having an end which extends and fits non-rotatably only into the tool-receiving socket and not on into the adjacent sleeve drive socket; and said handle element shank extending rotatably through the tool-receiving socket and non-rotatably into the adjacent sleeve drive socket.

* * * * *